US005660688A

United States Patent [19]

Kiviranta

[11] Patent Number: 5,660,688

[45] Date of Patent: Aug. 26, 1997

[54] METHOD AND DEVICE FOR WASHING A WIRE OF A PAPER OR BOARD MACHINE

[75] Inventor: Seppo Kiviranta, Jyväskylä, Finland

[73] Assignee: Valmet Corporation, Helsinki, Finland

[21] Appl. No.: 642,350

[22] Filed: May 3, 1996

[30] Foreign Application Priority Data

Sep. 15, 1995 [FI] Finland ..... 954342

[51] Int. Cl.[6] ..... D21F 1/32

[52] U.S. Cl. ..... 162/199; 162/275; 162/279

[58] Field of Search ..... 162/199, 275, 162/276, 277, 278, 279, 363, 364, 297

[56] References Cited

U.S. PATENT DOCUMENTS 5,120,401 6/1992 Kiviranta et al. ..... 162/275

FOREIGN PATENT DOCUMENTS

U930584 12/1993 Finland .

*Primary Examiner*—Donald E. Czaja
*Assistant Examiner*—Jose A. Fortuna
*Attorney, Agent, or Firm*—Steinberg, Raskin & Davidson, P.C.

[57] ABSTRACT

A device and method for washing a wire in a paper or board machine including a wash-nozzle pipe arranged at one side of the wire for spraying a jet of a washing liquid such as water at the wire. At an opposite side of the wire, a suction device applies suction to draw mist arising from the washing of the wire. Directly alongside the suction device, at the same side of the wire, there is a blow device, through which a gas such as air is blown onto the face of the wire and through the wire to dry the wire and remove additional water, dirt and/or other impurities not removed by the suction device.

20 Claims, 4 Drawing Sheets

METHOD AND DEVICE FOR WASHING A WIRE OF A PAPER OR BOARD MACHINE

FIELD OF THE INVENTION

The present invention relates to a device for washing and cleaning a wire and more particularly to a device for removing the mist arising in high-pressure washing of a wire, e.g., of a paper or board machine, and during cleaning of the wire.

The present invention also relates to a method for washing and cleaning a wire and more particularly to a method for removing mist arising in high-pressure washing of a wire, e.g., of a paper or board machine, and during cleaning of the wire.

BACKGROUND OF THE INVENTION

The current assignee's Finnish Patent No. 82,954, corresponding to U.S. Pat. No. 5,120,401 which is hereby incorporated by reference herein, describes a device for removing mist arising in high-pressure washing of a wire in a paper or board machine. In the disclosed device, a washing jet is directed at the wire from one side of the wire to thereby wash the wire, and a suction effect is applied through a suction device to draw the washing mist arising during the wire-washing, and a direct result thereof, at the opposite side of the wire. Preferably, a suction duct of the suction device is placed inclined in relation to the running direction of the wire so that an acute angle is defined between the suction duct at its opening and the running direction of the wire and opens in relation to the running direction of the wire, i.e., is aligned in line with the running direction of the wire, such that the mist can be guided accurately into the suction duct of the suction device as it is carried along with the wire. Moreover, in the device, at the forward side of the suction duct in relation to the running direction of the wire, a separate rib is employed which can be adjustably positioned relative to the suction duct. By means of the rib, it is possible to regulate the guiding of the mist into the suction duct and moreover, by its means, a detrimental effect of the boundary layer of humid air carried on the face of the wire upon the suction process is prevented.

Moreover, the assignee's Finnish Utility Model Application U930584 of earlier date, corresponding to U.S. patent application Ser. No. 08/350,273 which is hereby incorporated by reference herein, describes a device for removing washing mist in which the rib that can be positioned in a device such as described in FI 82,954 has been replaced by a stationary, relatively wide ceramic or equivalent rib, which may engage with and contact the wire. In such a case, the absorption of mist out of connection with the device is intensified further. In this construction, it is possible to use a plastic rib which has been reinforced, for example, by means of wear-proof additive components. The rib may also be a ceramic one. As the wire may reach contact with the rib face in this device, by means of the rib it is possible to deflect the wire to continuously keep the wire in contact with the rib to thereby enable adjustment of the tension of the wire.

OBJECTS AND SUMMARY OF THE INVENTION

It is an object of the present invention to provide a new and improved device for washing and cleaning a wire in a paper or board machine.

It is another object of the present invention to provide a new and improved method for washing and cleaning a wire in a paper or board machine.

It is yet another object of the present invention to provide a new and improved method and device for washing and cleaning a wire wherein, in addition to a washing device which sprays a washing liquid jet device at the wire and a suction device which draws mist produced by the washing, a device that blows drying air is employed in a position after the suction device in a running direction of the wire.

In order to achieve these objects and others, in the device in accordance with the invention, blow means are provided for blowing a gas that provides for drying of the wire, preferably an apparatus for blowing warm air, and are arranged at the same side of the wire at which the suction device for applying suction to draw the washing mist is placed. This apparatus is favorable from the point of view of the construction, because the suction device of the washing mist or mist jet and the blow means for supplying the drying air can be constructed as a unified frame construction, i.e., mounted to a single frame, which is provided with a connection for the moist air to be sucked away and an inlet connection for the air to be blown into connection with the wire as well as, moreover, an exhaust connection for the water gathered in the collecting trough.

According to the present invention, the suction device preferably comprises two ribs, preferably ceramic ribs, placed at both sides of the suction duct; at the inlet side and at the outlet side (as seen in the running direction of the wire) such that a portion of the suction duct and its opening are situated between the ribs. Further, the rib at the outlet side, i.e., the rearward rib in the running direction of the wire, is arranged to form a blow gap of the blow means, together with a third rib arranged adjacent thereto and spaced therefrom, which can be movably positioned, so as to blow drying air into connection with the wire.

Thus, the apparatus in accordance with the invention is mainly characterized in that at the opposite side of the wire from the washing mist spraying means, the apparatus comprises a suction device through which the mist arising in the washing of the wire is absorbed out of connection with the device, i.e., removed therefrom, and that, proximate and/or directly alongside the suction device at the same side of the wire, there is a blow device through which air is blown onto the face of the wire and through the wire. The air serves to dry the wire as well as to remove additional water, dirt and other impurities which were not removed by the suction device.

The method in accordance with the invention includes the steps of spraying a washing liquid jet toward the wire from a first side of the wire, removing mist arising from the spraying of the washing liquid jet at a second side of the wire opposite the first side, and blowing a gas such as air toward the wire from the second side of the wire at a location proximate to the location at which the mist is removed and after the location at which the mist is removed in a running direction of the wire. Further, a suction chamber and a suction duct in flow communication with the suction chamber can be provided through which the mist is removed, and the mist may be guided into the suction duct by arranging a suction opening of the suction duct to be oriented at an acute angle in relation to the running direction of the wire. In a preferred embodiment, first, second and third elongate ribs extend in a direction transverse to the running direction of the wire. The ribs are arranged on a frame at the second side of the wire, the first rib being spaced from the second rib such that at least a portion of the suction duct and/or the suction opening is situated therebetween, and the third rib being arranged adjacent the second rib and spaced therefrom such that at least a portion of a blow duct and/or a blow opening thereof, through which the air is blown at the wire, is situated therebetween. In one embodiment of the invention, the width of the blow duct can be adjusted in a direction parallel to the running direction of the wire. Also, in another embodiment, a rib is fixedly connected to a frame part at the second side of the wire to define in part a portion of the blow duct and/or its opening through which the air is blown toward the wire, and the frame part is removably connected to a stationary frame in any one of a plurality of positions such that the frame part and the rib are positionable in different positions in relation to the frame.

The invention will be described in the following with reference to some preferred embodiments of the invention illustrated in the figures in the accompanying drawings. The invention is however, not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
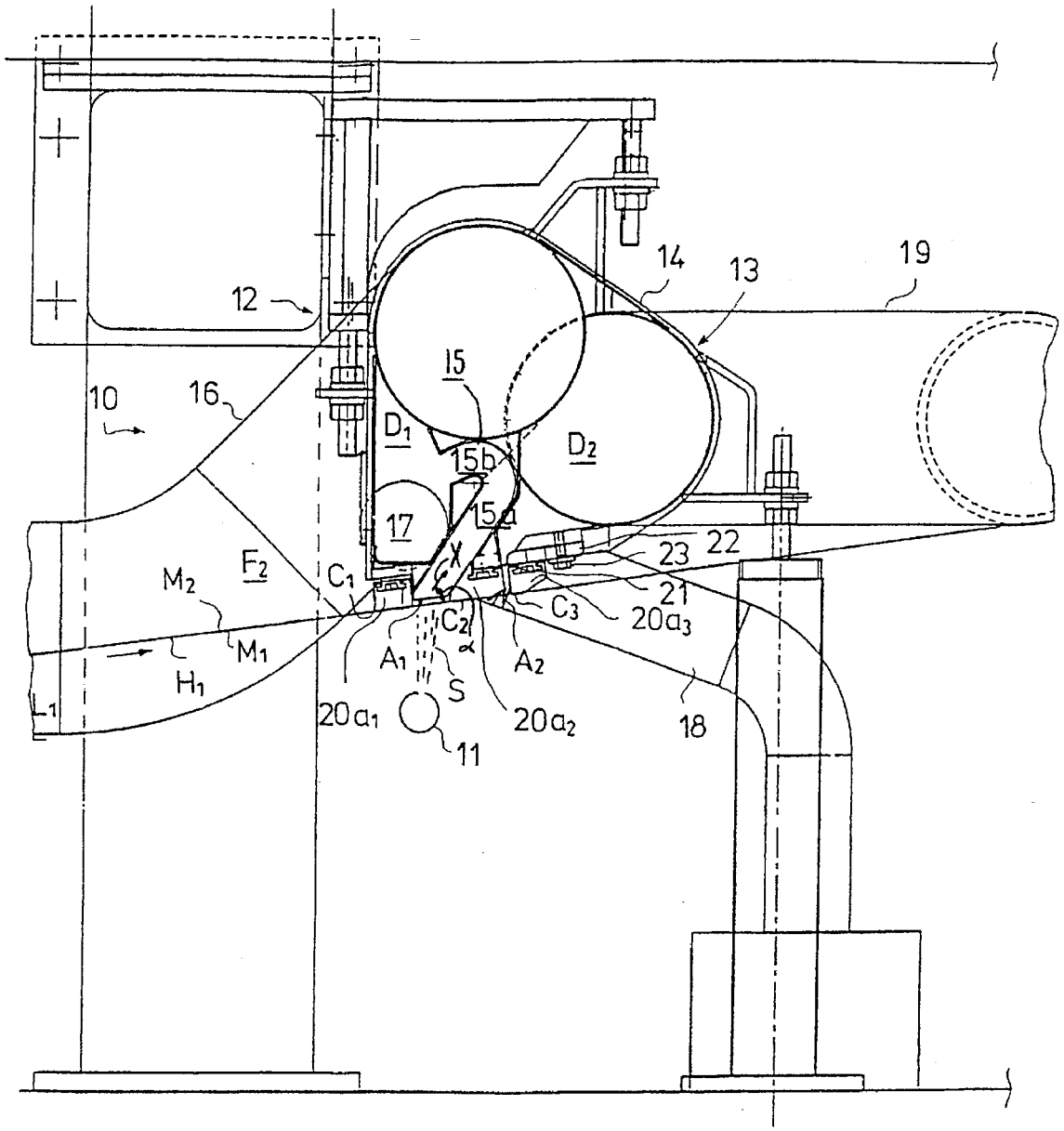
FIG. 1 is a sectional view of a device in accordance with the invention and used in a method in accordance with the invention.

Referring to the accompanying drawings wherein the same reference numerals refer to the same or similar elements, as shown in FIG. 1, a wire washing and cleaning device 10 in accordance with the invention comprises a wash-nozzle pipe 11 arranged at one side $F_1$ of a wire $H_1$ which sprays high-pressure washing liquid, such as water. The washing liquid is sprayed at a high pressure through nozzle openings as a jet S onto a face $M_1$ of the wire $H_1$.

The washing device 10 also comprises a suction device 12 and a blow device 13, which are mounted on a common frame 14, situated at an opposite side $F_2$ of the wire $H_1$ from the wash-nozzle pipe 11. The suction device 12 and the blow device 13 with their constructional pads, such as elongate ribs $\mathbf{20}a_1$,$\mathbf{20}a_2$,$\mathbf{20}a_3$, extend across the wire width, i.e., in a direction transverse to a running direction of the wire.

The suction device 12 comprises a suction duct 15 having a central axis X arranged at an oblique angle $\alpha$ in relation to the running direction $L_1$ of the wire $H_1$, i.e., is formed by the direction of running of the wire and the axis X of the suction duct 15 in a direction into the suction duct 15. The oblique acute angle $\alpha$ opens in the running direction $L_1$ of the wire $H_1$. A vacuum is applied in a suction chamber $D_1$ in the suction device 12 such that the mist jet arising during wire washing operation, as a result of the spraying of the washing liquid at the wire to remove did from the wire, is sucked or drawn through the suction duct 15 from the side $F_2$ of the wire into the suction duct 15 of the suction device 12 and further into the suction chamber $D_1$. In the suction chamber $D_1$, at least part of the water is separated into a collecting trough 17, from which it is passed through a drain duct 18 out of connection with the device i.e., completely removed therefrom. Another pad of the water that has been sucked or drawn into the suction chamber $D_1$ is removed through a duct 16. In an embodiment of the invention, some of the removed portion of air, which is unavoidably mixed with the removed mist and then separated therefrom, can be passed through a separate cleaning stage and cleaning device into the blow device 13 to constitute the blow air therefor.

The suction duct 15 comprises a straight duct portion 15*a* and, at its end, a curved duct portion 15*b* which opens into the suction chamber $D_1$.

The apparatus also comprises three ribs $\mathbf{20}a_1$,$\mathbf{20}a_2$,$\mathbf{20}a_3$ arranged in connection with the suction device 12 and the blow device 13, and possibly coupled to the same frame 14 as the suction device 12 and blow device 13. At both sides of the suction opening $A_1$ of the suction device 12, there are ribs; the rib $\mathbf{20}a_1$ at the inlet side in relation to the running direction $L_1$ of the wire, and at the opposite side of the opening $A_1$, at the trailing side in relation to the running direction of the wire, there is the second rib $\mathbf{20}a_2$. In this manner, ribs $\mathbf{20}a_1$ and $\mathbf{20}a_2$ define the suction opening $A_1$ therebetween. The ribs $\mathbf{20}a_1$,$\mathbf{20}a_2$ are preferably ceramic, highly wear-resistant ribs. They can also be made of some other material, such as plastic. Each rib $\mathbf{20}a_1$,$\mathbf{20}a_2$ and $\mathbf{20}a_3$ comprises a rather wide, about 20 mm to about 60 mm wide, face $C_1$,$C_2$ and $C_3$, respectively, which may reach contact with the face of the wire $H_1$.

In the construction shown in FIG. 1, the apparatus comprises the blow device 13 at the side of the suction device 12 at the side $F_2$ of the wire for blowing a gas such as air, preferably very dry heated air, out of a blow chamber $D_2$ of the blow device 13 into connection with the wire $H_1$ through a duct 19. The air is blown out of the blow chamber $D_2$ through a blow gap or duct $A_2$ defined between a side of the rib $\mathbf{20}a_2$ and a facing side of the third rib $\mathbf{20}a_3$ into connection with the wire $H_1$ onto its face $M_2$. The blow gap can also be profiled, in which case the blow effect is intensified at the desired point or desired points. Such points may be situated at the lateral areas of the wire.

The third rib $\mathbf{20}a_3$ is preferably displaceable in the running direction of the wire, in which case the width of the blow gap $A_2$ can be regulated. Thus, the third rib 20*a* is suitably coupled to displacement means to enable such regulation of the blow gap to thereby regulate the air flow, e.g., quantity, force, through blow gap $A_2$.

It is important to note that the suction device and the blow device should be placed at the same side of the wire (at the side $F_2$). In this manner, the blowing via the blow device is carried out in the direction opposite to the direction of suction of the humid air, this direction being also opposite to the direction of passing of the washing water through the wire.

In accordance with the invention, the construction described above is also favorable because the suction device 12 and the blow device 13 are placed side by side in close proximity to one another and constitute a compact, unified construction unit, which comprises a unified frame 14 that surrounds the device. Thus, the device is advantageous to construct, and the cost of its transportation to the installation site becomes low. According to the invention, three ribs are used, of which the middle rib $\mathbf{20}a_2$ operates both as a component that defines the nozzle or suction opening $A_1$ of the suction device 12 at one side and as a component that defines the blow-nozzle opening or blow gap $A_2$ of the blow device at another side. Thus, the number of the rib components has been minimized.

Figure 2A:
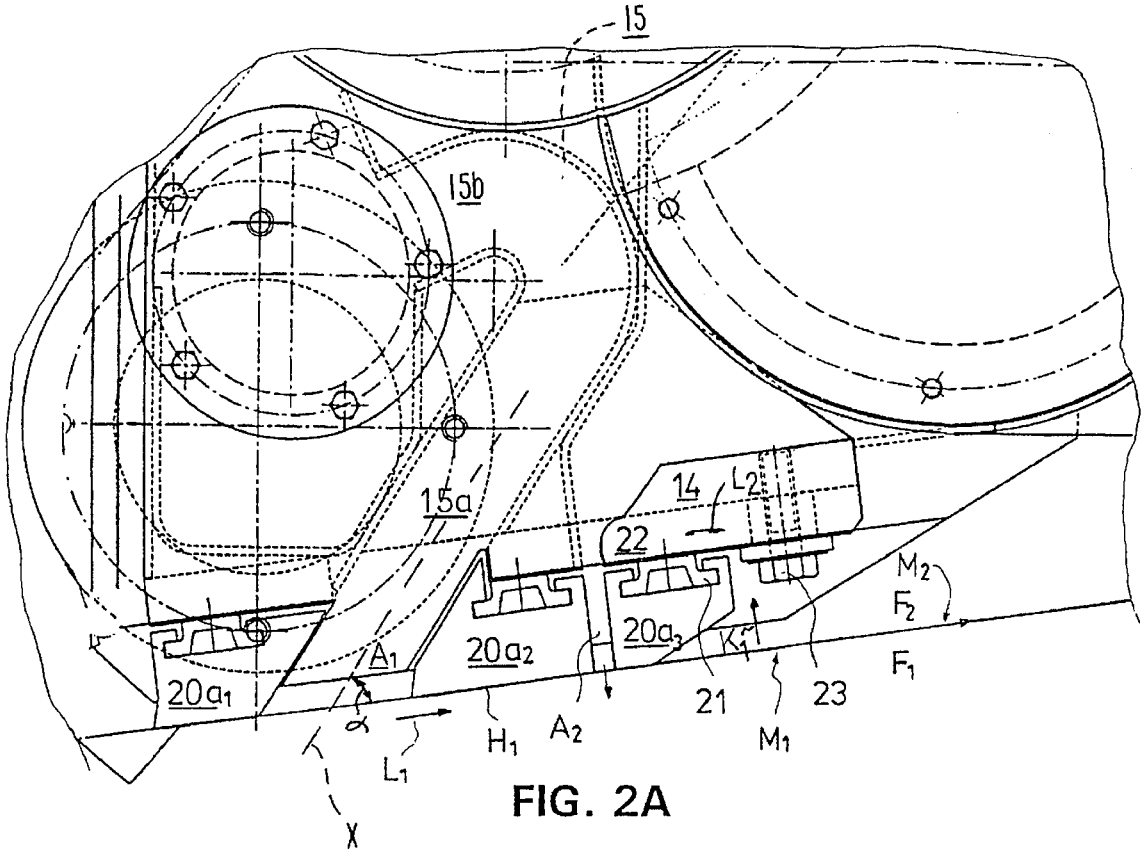
FIG. 2A shows a displaceable third rib connected with one example of a regulation mechanism for regulating the air-blow nozzle gap or blow opening.
Figure 2B:
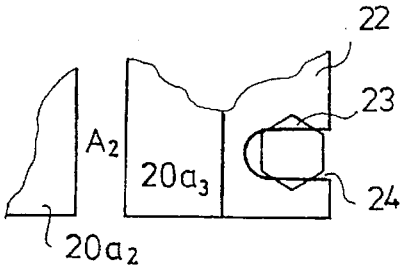
FIG. 2B shows the construction of FIG. 2A viewed in the direction of the arrow $K_1$ in FIG. 2A.

FIG. 2A illustrates one manner for providing the adjustability of the third rib $20a_3$ shown in FIG. 1. As shown in FIG. 2A, the third rib $20a_3$ can be movably positioned in the direction $L_2$. In this manner, the width of the blow gap $A_2$ defined between ribs $20a_2$ and $20a_3$ can be adjusted as desired. As shown in the figure, the third rib $20a_3$ is connected by means of a T-joint to the fastening rib 21 and the fastening rib 21 is further attached to the displaceable frame part 22, which in turn can be positioned in relation to the base frame 14 by means of a screw device 23 or equivalent attachment means. The displaceable frame includes a U-section opening 24 through which a screw 23 is passed and fixed to the frame 14 of the apparatus (FIG. 2B). Other suitable adjustment displacement means can also be used in accordance with the invention.

The ribs $20a_1$,$20a_2$,$20a_3$ are attached by suitable attachment means such as a T-joint or an equivalent joint to a separate fastening rib 21, which is fixed further to the frame 14 of the apparatus. In this manner, when the ribs $20a_1$, $20a_2$,$20a_3$ are replaced, they can be passed onto the fastening rib 21 from the end of the fastening rib.

FIG. 2B shows the apparatus of FIG. 2A viewed in the direction of the arrow $K_1$. The displaceable frame part 22 includes the U-section opening 24, opening in a direction substantially coincident with the running direction of the wire (as shown), through which the screw 23 is passed. When the screw 23 is opened somewhat, the frame part 22 and the fastening rib 21 attached to it can be positioned with a view toward adjusting the width of the blow gap $A_2$, i.e., the dimension of the blow gap $A_2$ in a direction parallel to the running direction of the wire. The screw 23 thus connect the frame part 22 to the frame 14 of the suction device 12 and blow device 13 in any one of a plurality of positions such that the frame part 22 and the rib attached to the fastening rib 21 are positionable in different positions in relation to the frame 14.

Figure 2C:
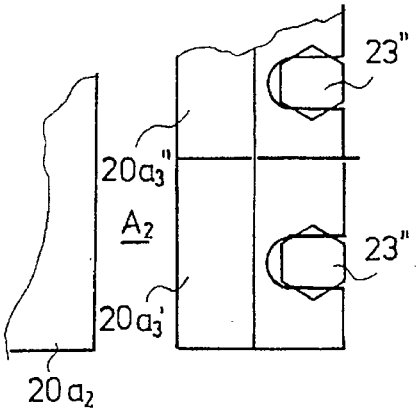
FIG. 2C illustrates the profiling of the supply of drying air across the machine width.

In the embodiment shown in FIG. 2C, by means of the screw arrangement, the width of the gap can also be adjusted in the cross direction of the machine. In this manner, it is possible to profile the supply of blow air across the machine width and thereby to regulate the drying capacity in the desired way. Different areas of the wire may have different requirements of drying. Thus, in the construction shown in FIG. 2C, the rib $20a_3$ may be composed of a plurality of component ribs $20a_3'$,$20a_3''$. . . , in which case the blow gap can be shaped as desired by individually and separately adjusting the component ribs $20a_3'$,$20a_3''$,$20a_3'''$ in relation to the middle rib $20a_2$ by means of the screws 23',23".

The profiling of the supply of air across the machine width can also be carried out so that the blow box is divided into compartments in the cross direction of the machine, into which compartments the air is supplied at different pressures. In such a case, the blow gap may have a substantially invariable width and yet, the blow capacity can be regulated across the wire width.

Figure 3:
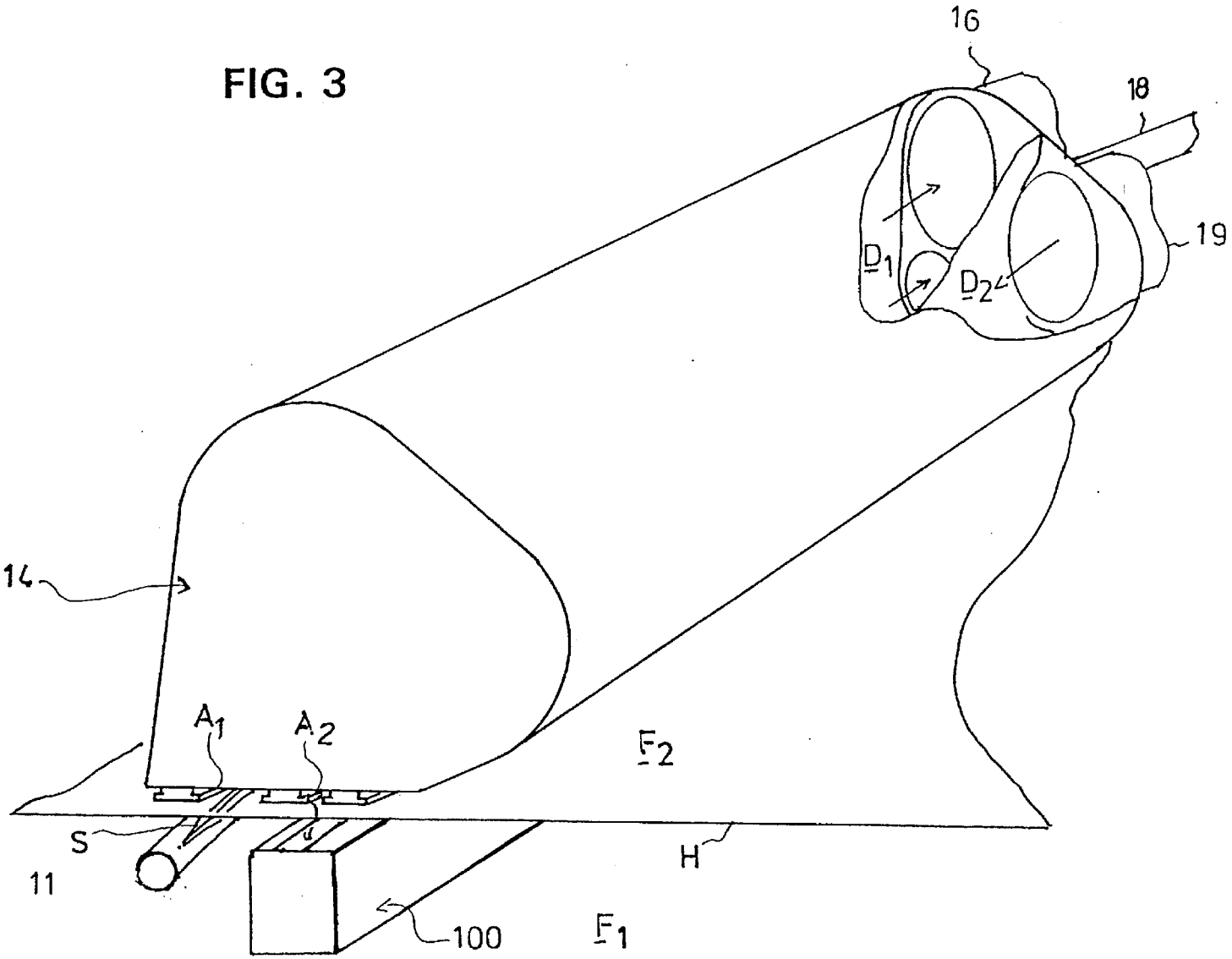
FIG. 3 is a perspective view of a device in accordance with the invention with portions removed.

FIG. 3 is a perspective view of a construction unit in accordance with the invention. The construction unit or frame 14 includes a suction device and a blow device which can be shifted as one compact unit to its site of operation in a paper/board machine. Also, at the opposite side of blowing (side $F_1$), there may be a suction box 100 so as to guide the blow air from the blow device 13 into the interior of the suction box 100 and further out of connection with the apparatus.

Figure 4:
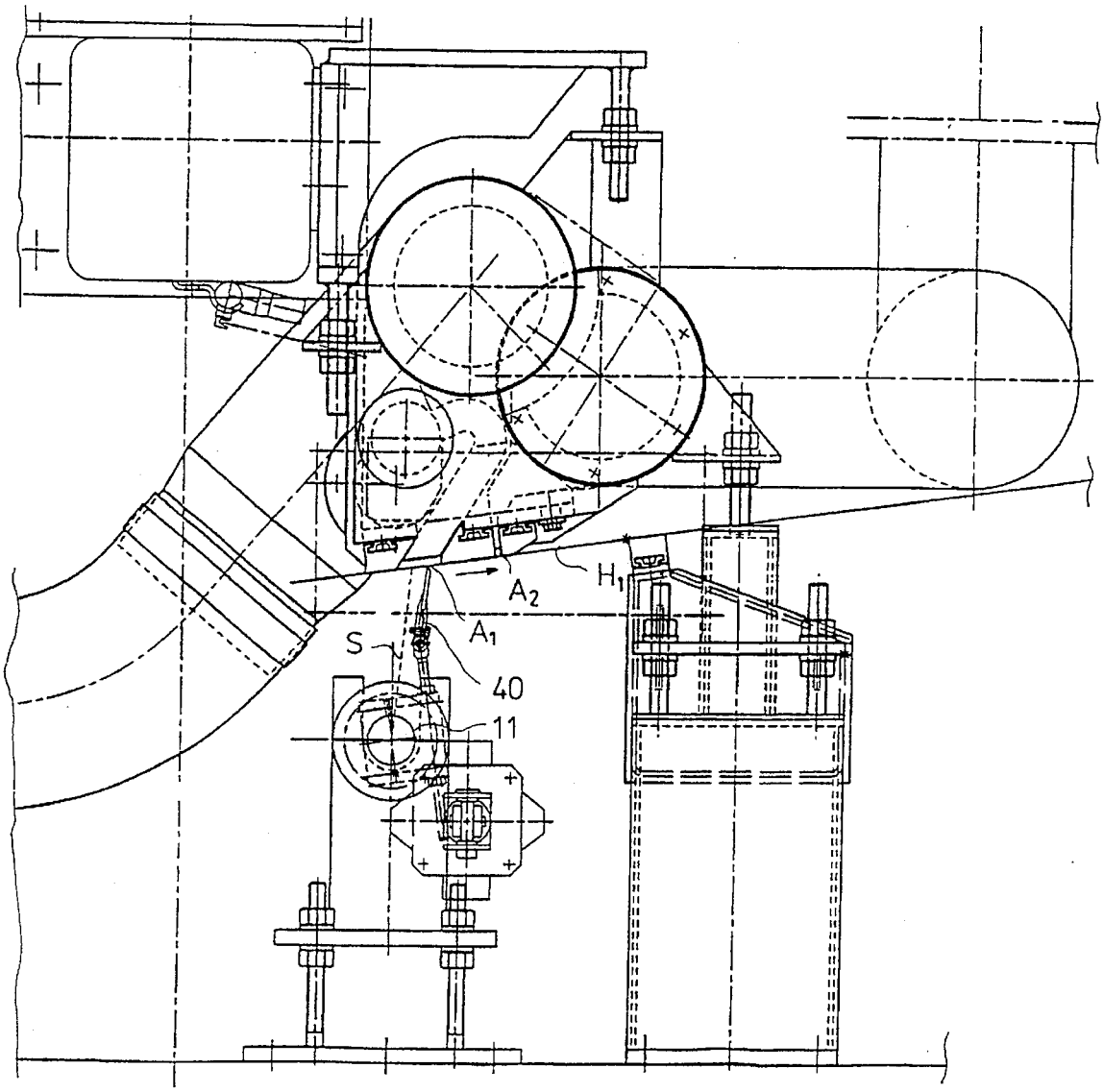
FIG. 4 shows an embodiment in which a plate is used for guiding the jet/mist into a suction device.

FIG. 4 shows an embodiment of the invention in which there is a jet guide plate 40 at the vicinity of the jet pipe, which plate guides the wash jet and the mist arising in washing towards the suction opening $A_1$ of the suction box. The plate 40 extends across the machine width, and its position is adjustable.

Reference numeral $20a_4$ denotes a rib situated in connection with the wire $H_1$ and placed on the same side of the wire as the wash-nozzle pipe 11. The function of the rib $20a_4$ is to aid in the removal of the water separated by the blowing from the wire and to serve as a support for the wire. If needed, the rib $20a_4$ can be shaped into a construction of a water-collecting-trough type.

The examples provided above are not meant to be exclusive. Many other variations of the present invention would be obvious to those skilled in the art, and are contemplated to be within the scope of the appended claims.

I claim:

1. A device for washing a wire in a paper or board machine, comprising spray means arranged on a first side of the wire for spraying a washing liquid jet at the wire, suction means arranged on a second side of the wire opposite said first side for removing mist arising from the spraying of the washing liquid jet, and blow means arranged proximate said suction means on said second side of the wire for blowing gas at the wire, said blow means being arranged after said suction means in a running direction of the wire.

2. The device of claim 1, wherein said spray means comprise a wash-nozzle pipe.

3. The device of claim 1, wherein said suction means comprise a suction chamber and a suction duct in flow communication with said suction chamber and having a suction opening, said suction duct being arranged at least partially at an acute angle in relation to the running direction of the wire such that the mist is drawn through said suction opening into said suction duct and therefrom into said suction chamber.

4. The device of claim 3, further comprising first and second elongate ribs extending in a direction transverse to the running direction of the wire, said suction opening of said suction duct being situated in a space defined between said first and second ribs.

5. The device of claim 1, wherein said blow means comprise a blow duct having a blow opening through which gas is blown at the wire, further comprising first and second elongate ribs extending in a direction transverse to the running direction of the wire and spaced apart from one another, said blow opening being situated in a space defined between said first and second ribs.

6. The device of claim 4, wherein said blow means comprise a blow duct having a blow opening through which gas is blown at the wire, further comprising a third elongate rib extending in a direction transverse to the running direction of the wire and arranged adjacent said second rib and spaced therefrom, said blow opening being situated in a space defined between said second and third ribs.

7. The device of claim 1, wherein said blow means comprise a blow duct having a blow opening through which the gas is blown at the wire and means for adjusting a width of said blow opening in the running direction of the wire.

8. The device of claim 7, wherein said adjusting means comprise a rib which defines in part said blow opening and displacement means for moving said rib.

9. The device of claim 8, further comprising a frame, said blow means being mounted on said frame, a frame part, said rib being fixedly connected to said frame part, and screw means for connecting said frame part to said frame in any one of a plurality of positions such that said frame part and said rib are positionable in different positions in relation to said frame.

10. The device of claim 6, further comprising a frame, said blow means and said suction means being mounted on said frame, a first, second and third fastening rib mounted on said frame, and attachment means for attaching said first, second and third ribs to a respective one of said first, second and third fastening ribs.

11. The device of claim 1, further comprising coupling means for coupling said blow means and said suction means in flow communication with each other such that at least part of the gas that is sucked by said suction means along with the mist is passed into said blow means.

12. The device of claim 1, wherein said blow means comprise an elongate blow opening arranged in a direction transverse to a running direction of the wire and adjusting means for adjusting the amount of gas supplied through said blow opening at a plurality of locations across a width of the web such that a profile of drying capacity is regulated across the width of the wire.

13. The device as of claim 1, further comprising guide means arranged after said spray means in the running direction of the wire for guiding the washing liquid jet toward the wire, said guide means comprising a plate.

14. The device of claim 1, wherein said suction means are directly alongside said blow means, the washing liquid jet is sprayed by said spray means directly at a first face of the wire, and the gas blown by said blow means is blown directly at a second face of the wire opposite said first face.

15. The device of claim 1, further comprising a rib arranged on said first side of the wire downstream of said suction means and said blow means, said rib engaging with the wire to support the wire and remove water therefrom.

16. A method for washing a wire in a paper or board machine, comprising the steps of:

spraying a washing liquid jet at a first side of the wire, removing mist arising from the spraying of the washing liquid jet from a location on a second side of the wire opposite said first side, and blowing gas at the second side of the wire at a location proximate to the location at which the mist is removed and after the location at which the mist is removed in a running direction of the wire.

17. The method of claim 16, further comprising the steps of:

providing a suction chamber and a suction duct in flow communication with said suction chamber through which the mist is removed, and drawing the mist into said suction duct by arranging said suction duct to open at an acute angle in relation to the running direction of the wire.

18. The method of claim 17, further comprising the steps of:

arranging first, second and third elongate ribs successively on a frame at said second side of the wire to extend in a direction transverse to the running direction of the wire, said first rib being arranged before said second rib in the running direction of the wire, positioning an opening of said suction duct between said first rib and said second rib, and positioning an opening of a blow duct through which the gas is blown at the second side of the wire between said second rib and said third rib.

19. The method of claim 18, further comprising the step of:

adjusting a width of said blow duct in the running direction of the wire.

20. The method of claim 16, further comprising the steps of:

mounting a suction device through which the mist is removed from said second side of the wire and a blow device from which gas is blow at the wire on a single frame, fixedly connecting a rib to a frame part at said second side of the wire to define in part a portion of a blow duct through which the gas is blown at the wire, and removably connecting said frame part to said single frame in any one of a plurality of positions such that said frame part and said rib are positionable in different positions in relation to said frame.

* * * * *